US011273964B2

(12) United States Patent
Berge

(10) Patent No.: US 11,273,964 B2
(45) Date of Patent: Mar. 15, 2022

(54) HINGED CLOSURE

(71) Applicant: Silgan White Cap LLC, Downers Grove, IL (US)

(72) Inventor: Gary L. Berge, Crystal Lake, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

(21) Appl. No.: 16/888,145

(22) Filed: May 29, 2020

(65) Prior Publication Data

US 2021/0371177 A1 Dec. 2, 2021

(51) Int. Cl.
*B65D 55/16* (2006.01)
*B65D 41/34* (2006.01)

(52) U.S. Cl.
CPC ..... *B65D 55/16* (2013.01); *B65D 41/3442* (2013.01)

(58) Field of Classification Search
CPC ..... B65D 55/16; B65D 41/3442; B65D 2401/15; B65D 47/0809; B65D 47/0814; B65D 41/3428
USPC ..... 215/252
See application file for complete search history.

(56) References Cited

U.S. PATENT DOCUMENTS 9,108,774 B2 * 8/2015 Kwon ..... B65D 55/16
9,415,909 B2 * 8/2016 Druitt ..... B65D 47/0809
10,654,624 B2 * 5/2020 Sung ..... B65D 25/42
10,926,923 B2 * 2/2021 Berroa Garcia ..... B65D 41/32
2008/0169261 A1 * 7/2008 Druitt ..... B65D 47/0809 215/237
2011/0174760 A1 7/2011 Luzzato et al.
2012/0298666 A1 11/2012 Kwon

FOREIGN PATENT DOCUMENTS

JP 2003-221053 8/2003
JP 2019-055816 4/2019
WO WO 2019/175740 9/2019

OTHER PUBLICATIONS

International Search Report and Written Opinion for International Application No. PCT/US2021/029674, dated Jul. 29, 2021, 10 pages.

* cited by examiner

*Primary Examiner* — Shawn M Braden
(74) *Attorney, Agent, or Firm* — Reinhart Boerner Van Deuren s.c.

(57) ABSTRACT

A closure includes a cap having a top wall and a skirt perpendicular to the top wall and extending downwardly from the top wall to a lower edge. The skirt includes an inner surface having a sealing formation. A band is concentric with and attached to the lower edge of the skirt by a plurality of frangible members. A tab is formed at a hinge location from the band and extending from the lower edge of the skirt to a pair of co-linear slits in the band separated by a frangible member. The tab is bounded by a pair of slits extending from the lower edge of the skirt to the pair of co-linear slits, with each of the pair of slits being separated from a respective first co-linear slit by a respective frangible member.

20 Claims, 10 Drawing Sheets

HINGED CLOSURE

BACKGROUND OF THE INVENTION

The present disclosure relates generally to the field of closures for containers. The present disclosure relates specifically to a closure for a container having a cap and a tab, with the tab maintaining the cap in an open position.

SUMMARY OF THE INVENTION

In one aspect, this disclosure relates to a closure for a container. The closure includes a top panel defining an upper surface and an opposing lower surface, a rotational axis around which the top panel is centered, an annular wall extending from the lower surface of the top panel to a bottom edge of the annular wall, an inner surface of the annular wall facing towards the rotational axis and extending a first distance from the rotational axis, a hinge having an inner surface that extends a second distance from the rotational axis that is less than the first distance, and a retention band pivotally attached to the annular wall by the hinge and attached to the bottom edge by a plurality of frangible members that break a first time the annular wall is pivoted with respect to the retention band.

In a specific embodiment, the hinge extends circumferentially around the rotational axis from a first end to a second end, which collectively define an angle with respect to the rotational axis between 10 degrees and 65 degrees.

In various embodiments, the hinge extends circumferentially around the rotational axis from a first end to a second end. The hinge defines a lower edge and an opposing upper edge, a first height between the lower edge and the upper edge at the first end of the hinge, a second height between the lower edge and the upper edge at the second end of the hinge, and a third height between the lower edge and the upper edge at a central portion of the hinge circumferentially halfway between the first end and the second end. The third height is less than each of the first height and the second height.

In a specific embodiment, the central portion of the hinge that defines the third height extends circumferentially around the rotational axis from a first end to a second end, which collectively define an angle with respect to the rotational axis that is less than 50 degrees. In a specific embodiment, the first end of the hinge and the lower edge of the hinge define an angle between 55 degrees and 80 degrees. In a specific embodiment, the hinge defines a central line that extends parallel to the rotational axis of the closure, and the hinge is symmetrical with respect to the central line. In a specific embodiment, the hinge is coupled to the annular wall via a plurality of elongate frangible connections.

In one aspect, this disclosure relates to a method of manufacturing a closure for a container. A first form of the closure is manufactured, such as by injection molding and/or compression molding. The closure includes a top panel defining an upper surface and an opposing lower surface, a rotational axis around which the top panel is centered, a cylindrical wall extending from the lower surface of the top panel, and a hinge extending inwardly from the cylindrical wall towards the rotational axis. A blade is then used to cut the closure to form an annular wall extending from the lower surface of the top panel to a bottom edge of the annular wall, and a retention band pivotally attached to the bottom edge of the annular wall by the hinge and attached to the bottom edge by a plurality of frangible members that break a first time the annular wall is pivoted with respect to the retention band.

In a specific embodiment, an outer surface of the annular wall faces away from the rotational axis, and the outer surface at the bottom edge of the annular wall extends a first distance from the rotational axis, and an outer surface of the hinge extends a second distance from the rotational axis that is less than the first distance. In a specific embodiment, the hinge extends circumferentially around the rotational axis from a first end to a second end, which collectively define an angle with respect to the rotational axis between 30 degrees and 60 degrees.

In a specific embodiment, the hinge extends circumferentially around the rotational axis from a first end to a second end, the hinge defines a lower edge and an opposing upper edge. The hinge defines a first height between the lower edge and the upper edge at the first end of the hinge, a second height between the lower edge and the upper edge at the second end of the hinge, and a third height between the lower edge and the upper edge at a central portion of the hinge circumferentially halfway between the first end and the second end. The third height is less than each of the first height and the second height.

In a specific embodiment, the central portion extends circumferentially around the rotational axis from a first central end to a second central end, which collectively define an angle with respect to the rotational axis between 20 degrees and 50 degrees. In a specific embodiment, the first end of the hinge and the lower edge of the hinge define an angle between 40 degrees and 85 degrees.

In one aspect, this disclosure relates to a closure for a container. The closure includes a top panel defining an upper surface and an opposing lower surface, a rotational axis around which the top panel is centered, an annular wall extending from the lower surface of the top panel to a bottom edge of the annular wall, a hinge extending from the annular wall, a retention band pivotally attached to the bottom edge of the annular wall by the hinge and attached to the bottom edge by a plurality of frangible members that break a first time the annular wall is pivoted with respect to the retention band, and an interference band that extends from the retention band inwardly towards the rotational axis. The interference band extends a first length from a base of the retention band at a first location beneath the hinge, and a second length from the base of the retention band at a second location. The second location is opposite the first location with respect to the rotational axis, and the second length is greater than the first length.

In a specific embodiment, the first length is less than 60% of the second length. In a specific embodiment, the first length is less than 50% of a third length from a bottom of the retention band to a top of the retention band.

In a specific embodiment, the closure also includes an inner surface of the annular wall facing towards the rotational axis, the inner surface of the annular wall at the bottom edge of the annular wall extending a first distance from the rotational axis, and an inner surface of the hinge facing towards the rotational axis, the inner surface of the hinge extending a second distance from the rotational axis that is less than the first distance.

In a specific embodiment, the closure also includes an outer surface of the annular wall facing away from the rotational axis, the outer surface at the bottom edge of the annular wall extending a first distance from the rotational axis, an outer surface of the hinge facing away from the rotational axis, and the outer surface of the hinge extending a second distance from the rotational axis that is less than the first distance.

In various embodiments, the hinge extends circumferentially around the rotational axis from a first end to a second end. The hinge defines a lower edge and an opposing upper edge, a first height between the lower edge and the upper edge at the first end of the hinge, a second height between the lower edge and the upper edge at the second end of the hinge, and a third height between the lower edge and the upper edge at a central portion of the hinge circumferentially halfway between the first end and the second end. The third height is less than each of the first height and the second height.

In a specific embodiment, the hinge comprises a central portion over which the hinge defines the third height, the central portion extends circumferentially around the rotational axis from a first end to a second end, the first end and the second end define an angle with respect to the rotational axis that is less than 50 degrees wherein the first end of the hinge and the lower edge of the hinge define an angle between 55 degrees and 80 degrees.

Additional features and advantages will be set forth in the detailed description which follows, and in part will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide a further understanding, and are incorporated in, and constitute a part of this specification. The drawings illustrate one or more embodiments and together with the description serve to explain principles and operation of the various embodiments.

DETAILED DESCRIPTION

This disclosure provides a description for various embodiments of a closure with a recessed hinge that pivotally couples the retention band with the annular wall and top panel. The hinge is recessed relative to the annular wall of the closure, thus presenting an inner surface and an outer surface that are closer to the central rotational axis of the closure compared to the annular wall inner surface and outer surface. This positioning of closure enables a reduced complexity for manufacturing the closure. The weakened section between the annular wall and the retention band can therefore be cut by a blade to a depth that does not cut the hinge. Thus, management of the blade is simpler, allowing the blade to be permitted to circle the entire circumference of the closure without cutting the hinge. An interference band, such as a J-band, extends from the retaining band and interfaces with the container neck when the closure is opened. In a specific embodiment, the interference band is tapered such that the interference band has a variable length around the circumference of the closure, from a shortest length beneath the hinge to a longest length opposite the hinge.

Figure 1:
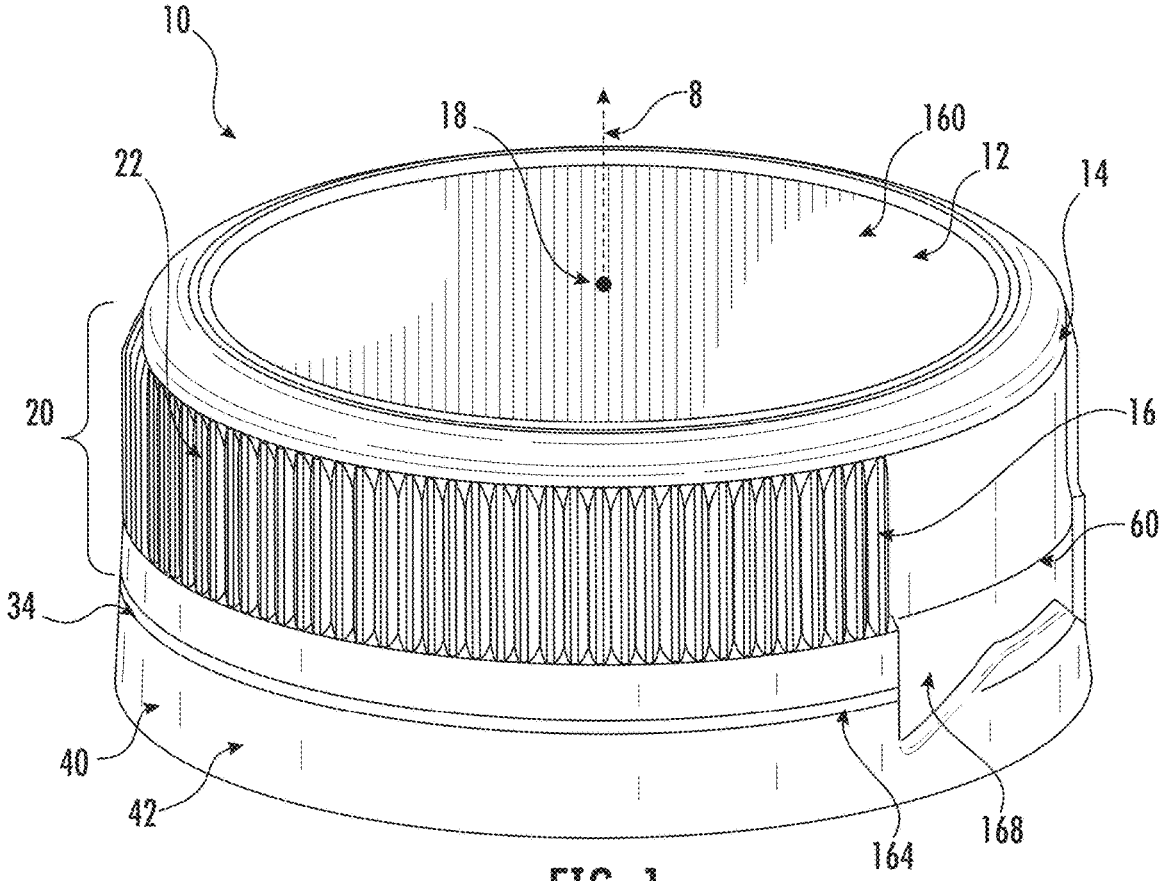
FIG. 1 is a perspective view of a closure, according to an exemplary embodiment.
Figure 2:
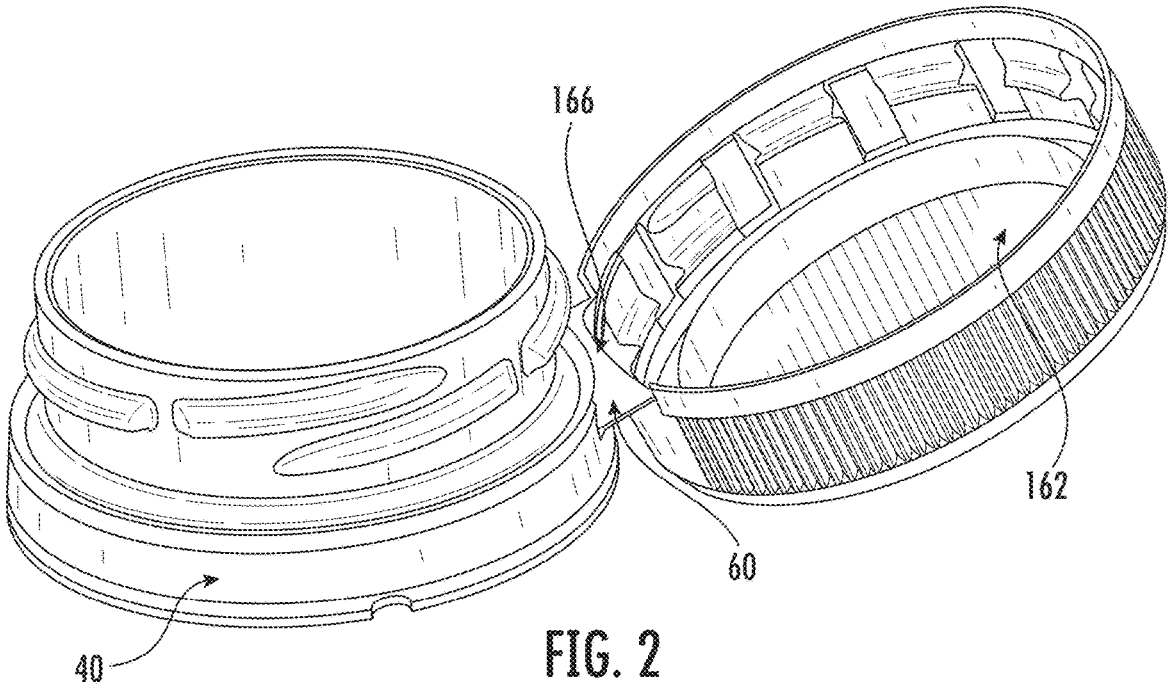
FIG. 2 is a perspective view of the closure of FIG. 1 in an open position on a container.
Figure 3:
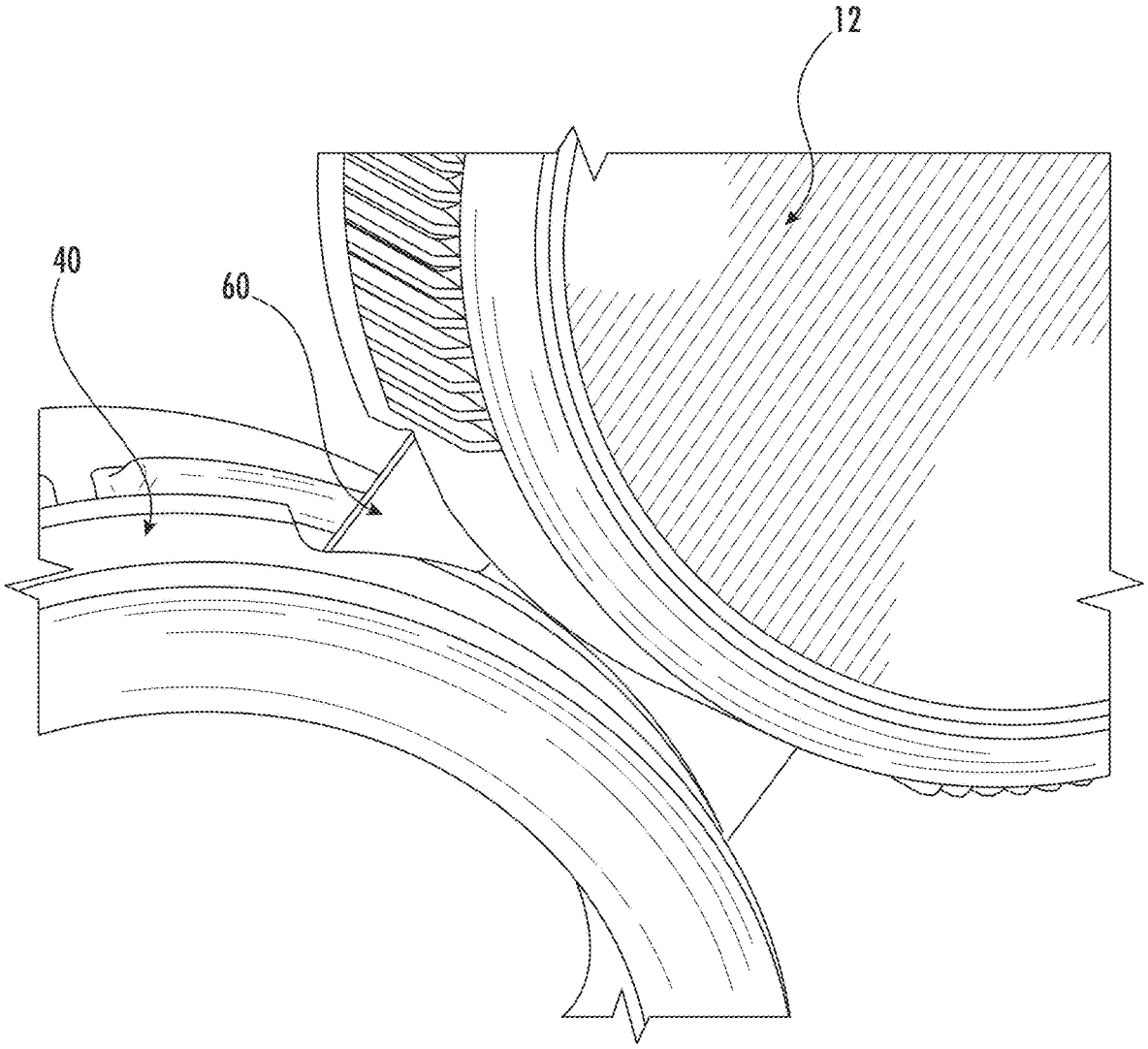
FIG. 3 is a detailed bottom view of the closure of FIG. 1 in an open position on a container.

Referring first to FIGS. 1-3, in an embodiment, a closure 10, for closing a container is shown. A top panel 12 rotates around axis 8 and is centered around center 18, which is aligned with axis 8. Top panel 12 defines upper surface 160 and opposing lower surface 162. Annular wall 16 extends downwardly from lower surface 162 of top panel 12 at periphery 14 of top panel 12 to bottom edge 164 of lower portion 28 of annular wall 16. Grip portion 22 of annular wall 16 comprises one or more knurls, and hinge 60 extends from annular wall 16. Retention band 40 is pivotally coupled to annular wall 16 via hinge 60. When closure 10 is in the closed arrangement, hinge 60 defines inner surface 166, which faces towards axis 8, and opposing outer surface 168. Retention band 40 defines outer surface 42, which faces away from axis 8 when closure 10 is in the closed arrangement. In a specific embodiment hinge 60 is recessed relative to annular wall 16.

Top panel 12 and annular wall 16 collectively define body 20 of closure 10, and retention band 40 is coupled to annular wall 16 via one or more frangible connections 46, which transit weakened section 34. In use, the first time closure 10 is opened body 20 pivots away from retention band 40 via hinge 60, thereby breaking frangible connections 46.

Figure 4:
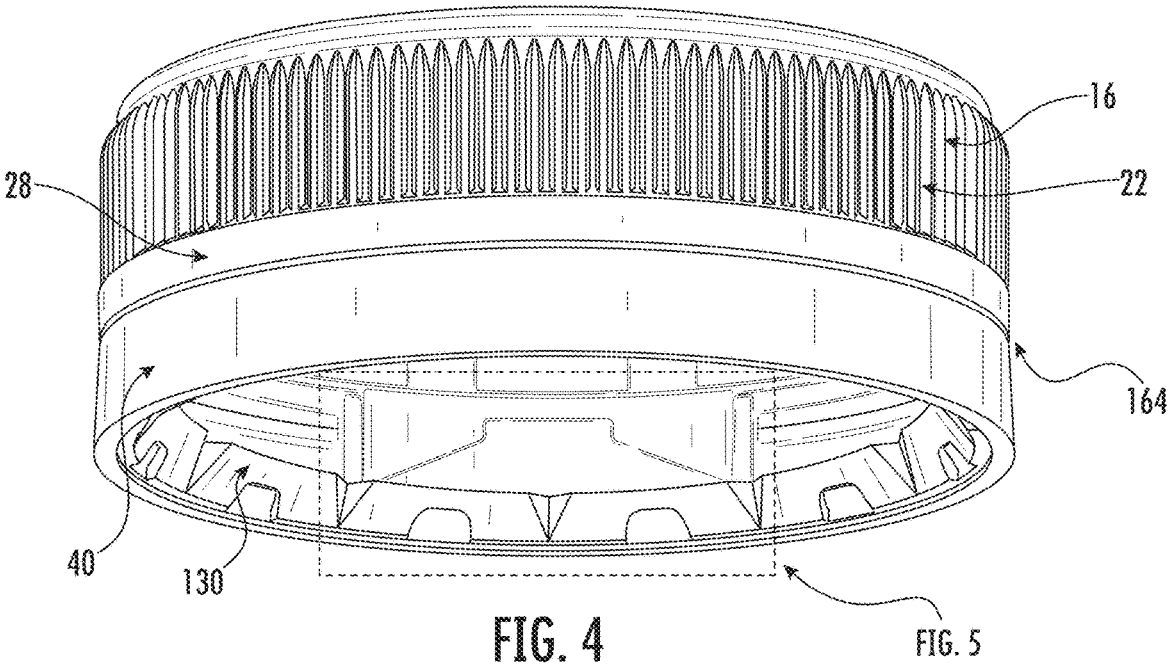
FIG. 4 is a perspective view of the closure of FIG. 1.
Figure 5:
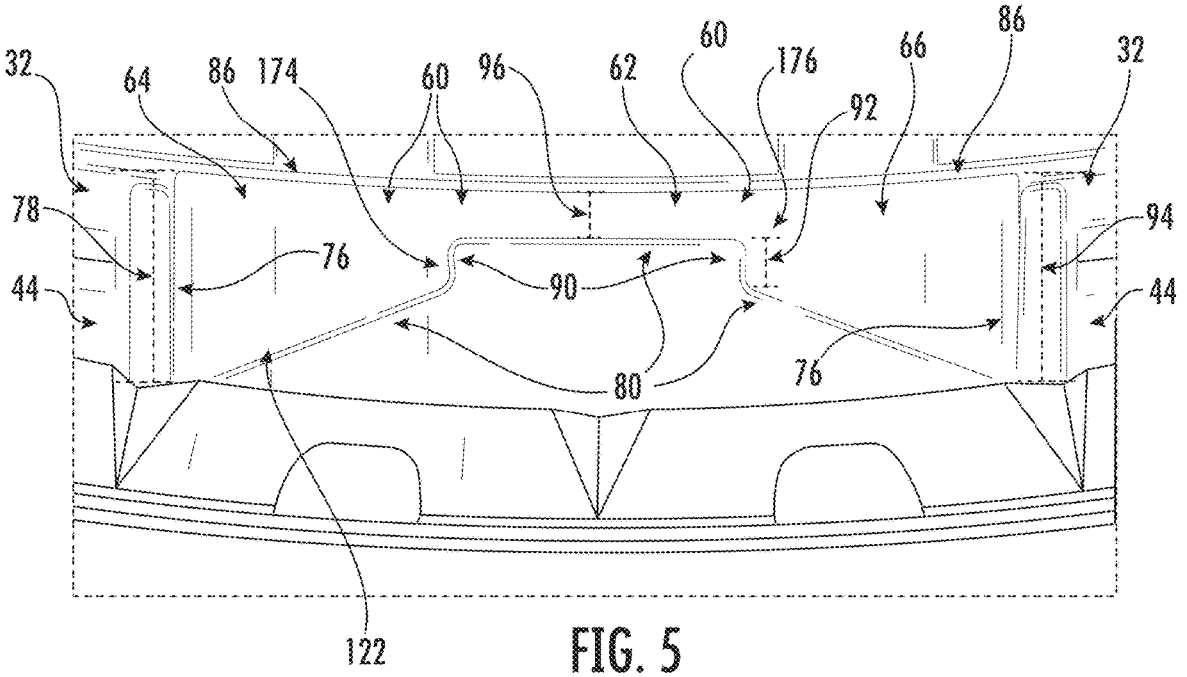
FIG. 5 is a detailed perspective view of the closure of FIG. 4.

Turning to FIGS. 4-5, described therein are various aspects of hinge 60 are shown. Hinge 60 includes central portion 62, and first side portion 64 and opposing second side portion 66 on either side of central portion 62. Central portion 62 extends circumferentially from first end 174 to second end 176. Central portion 62 extends height 96 from bottom edge 80 to upper edge 86. Lateral edges 76 of each of first side portion 64 and second side portion 66 extend height 78 and height 94, respectively. Hinge 60 extends vertically from lower edge 80 to upper edge 86. Bottom edge 80 of first side portion 64 and lateral edge 76 define angle 122. In a specific embodiment angle 122 is between 40 degrees and 85 degrees, and more specifically is between 55 degrees and 80 degrees, and more specifically is between 72 degrees and 75 degrees.

Inner edge 90 of bottom edge 80 vertically extends height 92, and retention band 40 defines interior surface 44, which faces inwardly towards axis 8. Lower portion 28 of annular wall 16 defines inner surface 32, which faces inwardly towards axis 8 when closure 10 is in the closed arrangement.

In a specific embodiment, height 96 of hinge 60 at a circumferential center of hinge 60 with respect to axis 8 is less than both height 78 and height 94 of lateral edges 76.

Figure 6:
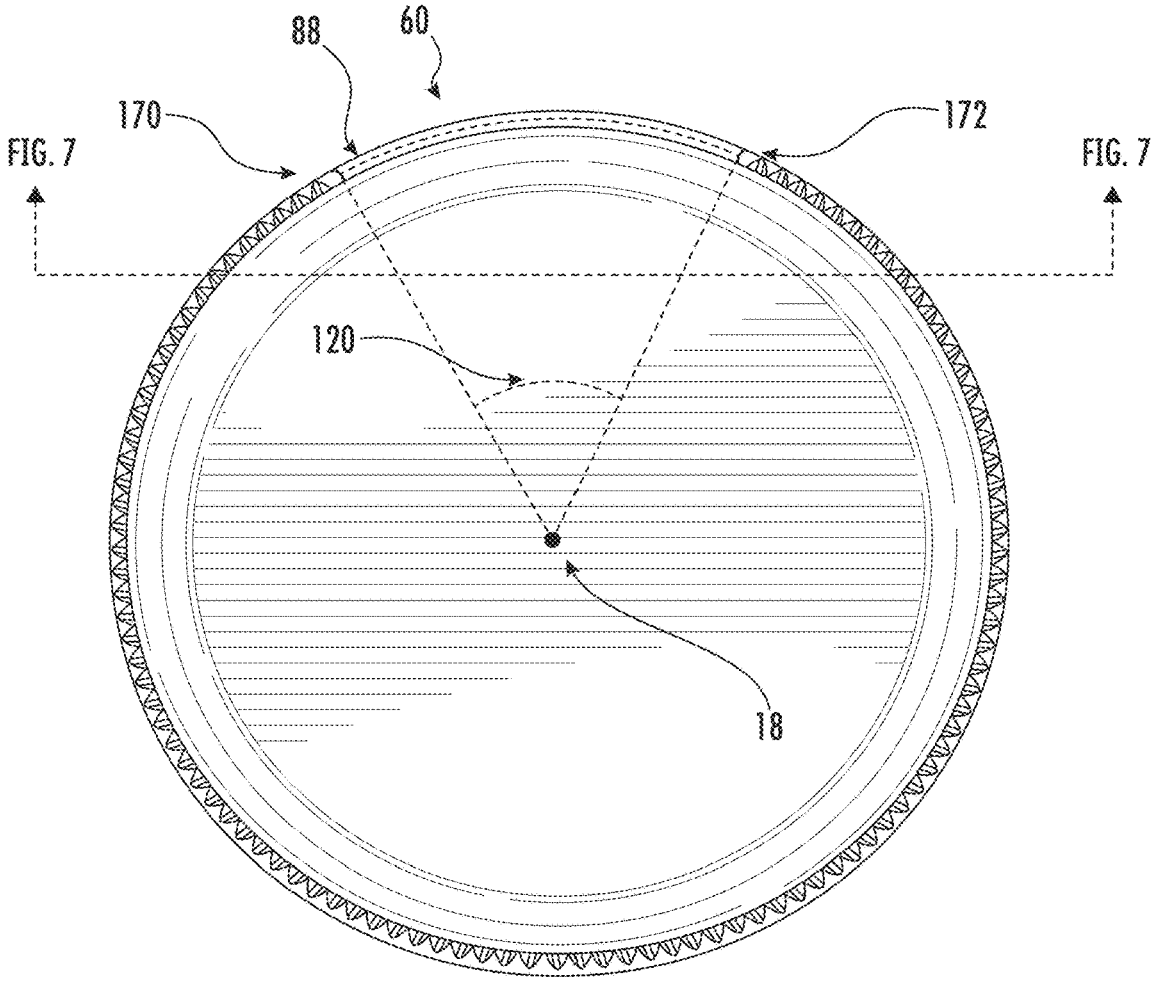
FIG. 6 is a top view of the closure of FIG. 1.
Figure 7:
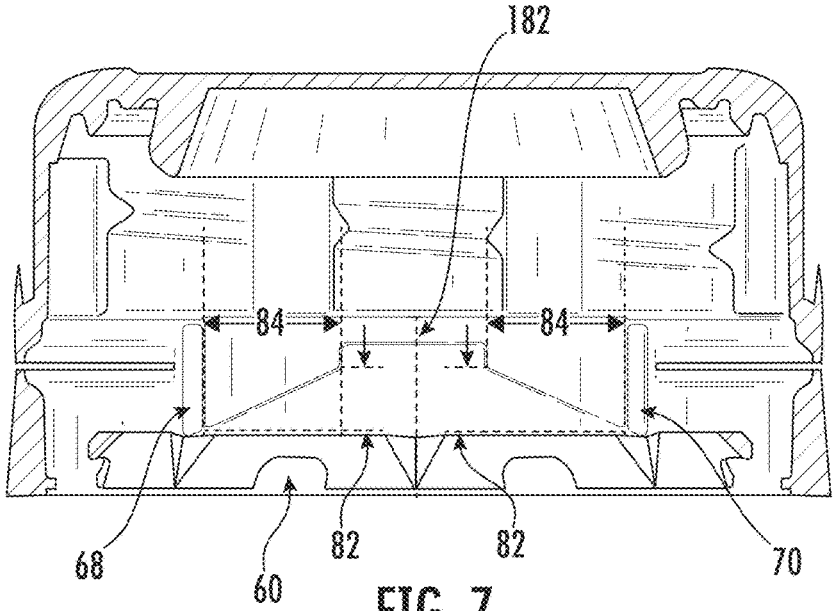
FIG. 7 is a cross-section view of the closure of FIG. 6.

Turning to FIGS. 6-7, described there are various further aspects of hinge 60 are shown. Hinge 60 extends circumferentially around axis 8 from first end 170 to second end 172. First end 170 and second end 172 collectively define angle 120, defining circumferential width 88 of hinge 60. In a specific embodiment angle 120 is between 10 degrees and 65 degrees, and more specifically is between 30 degrees and 60 degrees, and more specifically is between 45 degrees and 55 degrees, and even more specifically is between 51 degrees and 53 degrees.

Turning to FIG. 7 in particular, hinge 60 is laterally coupled to annular wall 16 and retention band 40 via elongate sidewall 68 and elongate sidewall 70 on either side of hinge 60. Side portions 64, 66 of hinge 60 define height 82 and width 84. In a specific embodiment hinge 60 is circumferentially symmetrical with respect to central line 182. When closure 10 is opened for the first time, elongate frangible sidewalls 68, 70 break, permitting body 20 to pivotally rotate with respect to retention band 40.

Figure 8:
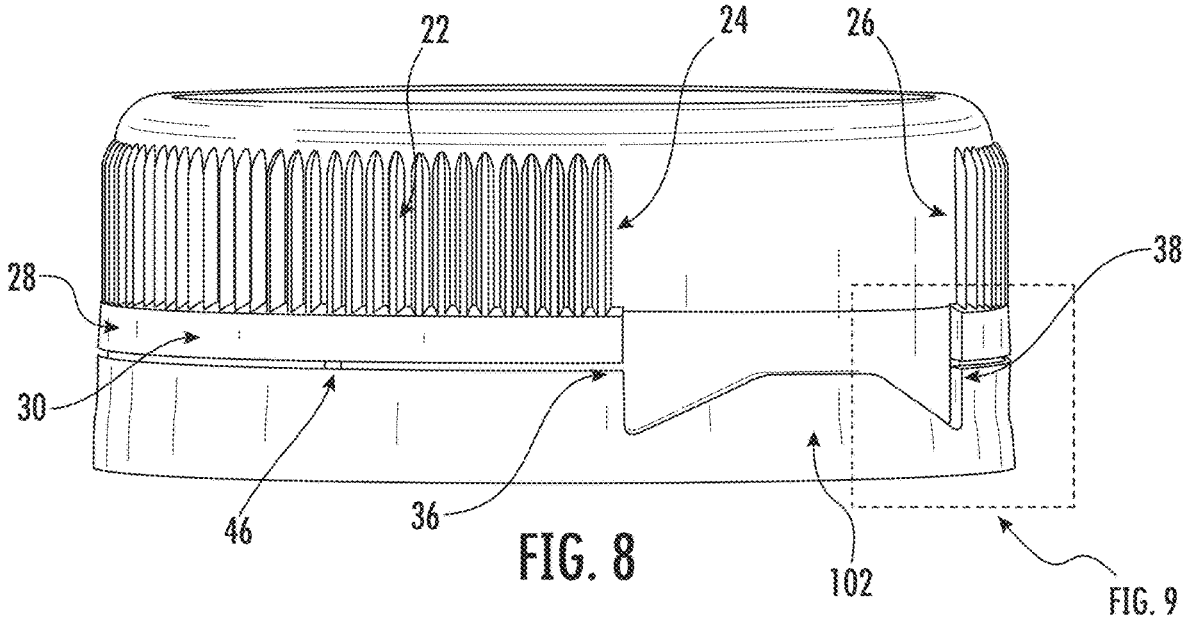
FIG. 8 is a side view of the closure of FIG. 1.
Figure 9:
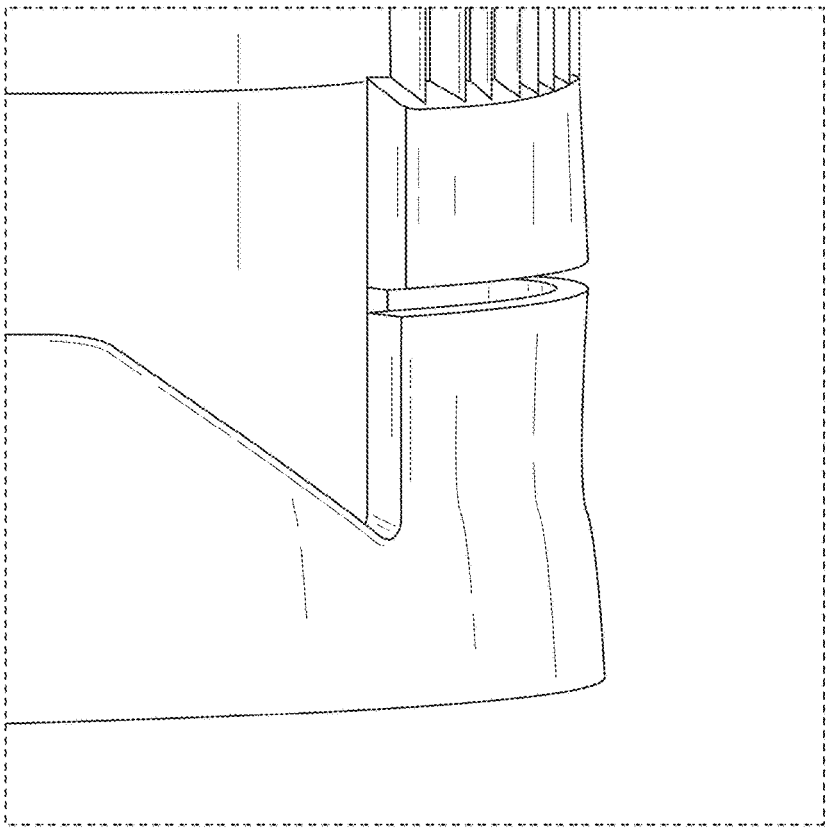
FIG. 9 is a detailed side view of the closure of FIG. 9.

Turning to FIGS. 8-9, described herein are various aspects of closure 10. Grip portion 22 extends circumferentially around closure 10 from first end 24 to second end 26, and weakened section 34 similarly circumferentially extends around closure 10 from first end 36 to second end 38. Lower portion 28 of annular wall 16 defines outer surface 30, which faces away from rotational axis 8 when closure 10 is in the closed position. In a specific embodiment, grip portion 22 does not extend above hinge 60, and base 102 is positioned below hinge 60 when closure 10 is in the closed arrangement.

Figure 10:
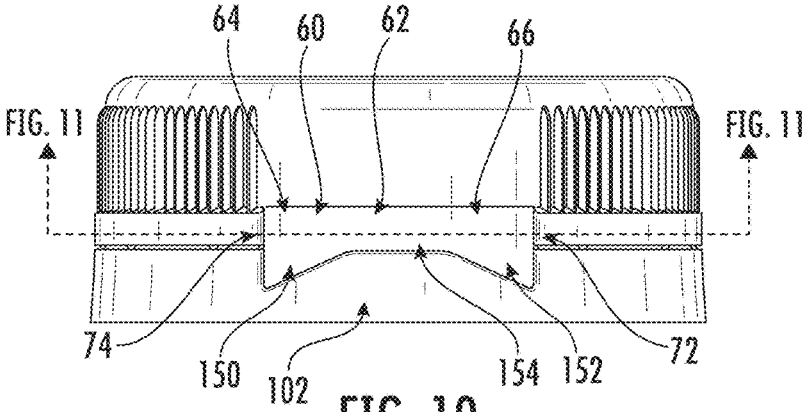
FIG. 10 is a side view of the closure of FIG. 1.
Figure 11:
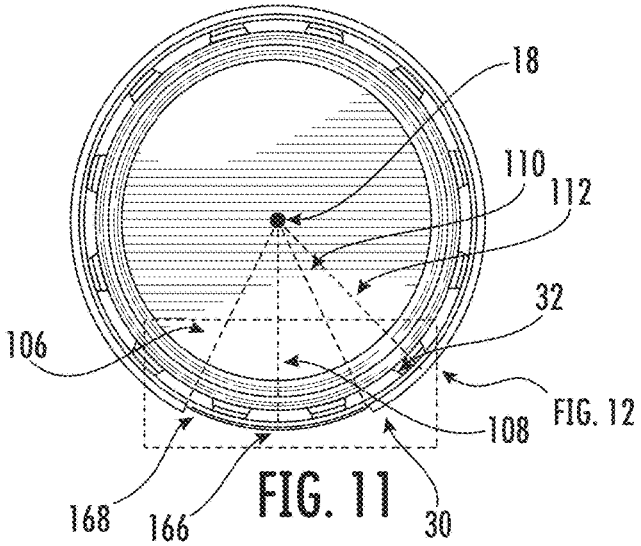
FIG. 11 is a cross-section view of the closure of FIG. 11.
Figure 12:
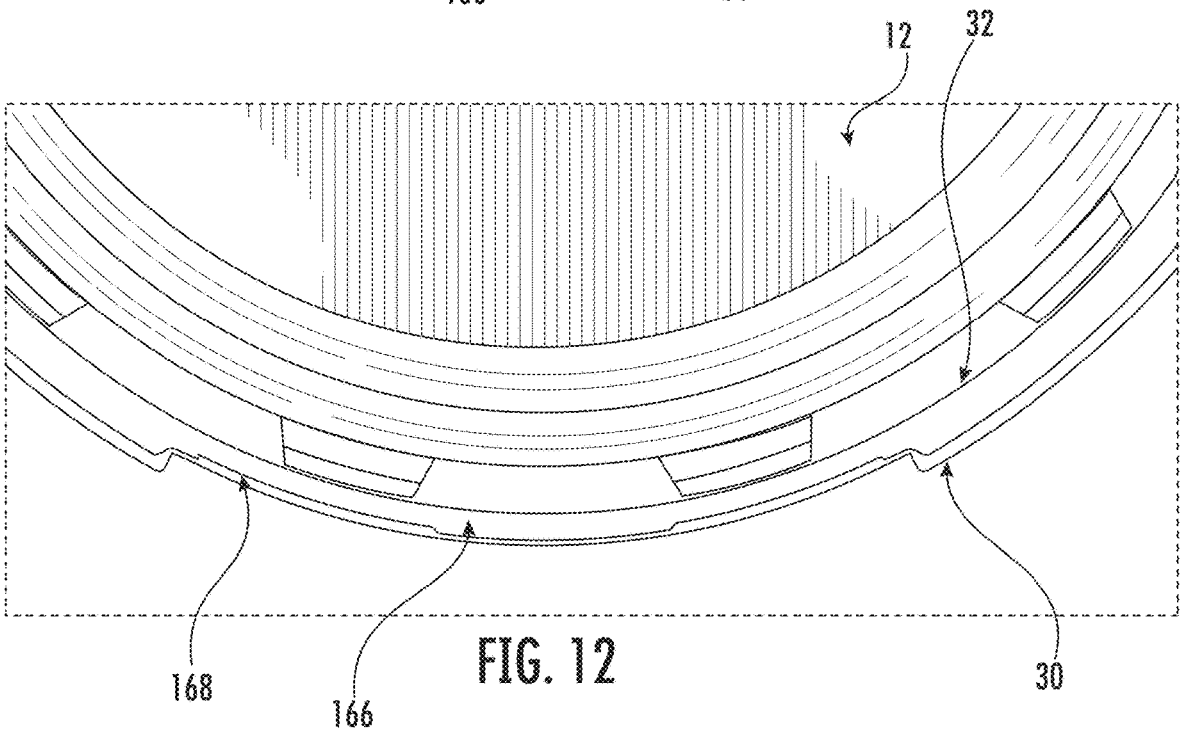
FIG. 12 is a detailed cross-section view of the closure of FIG. 12.

Turning to FIGS. 10-17, various aspects of closure 10 are shown via several cross-sections of closure 10. Turning to FIGS. 10-12 in particular, hinge 60 includes central portion 62, first side portion 64 and second side portion 66. Central portion 62 defines outer surface 154, first side portion 64 defines outer surface 150, and second side portion 66 defines outer surface 152. Turning to FIG. 11 in particular, outer surface 168 of hinge 60 defines distance 106 from center 18, inner surface 166 of hinge 60 defines distance 108 from center 18, outer surface 30 of lower portion 28 defines distance 110 from center 18 (e.g., at bottom edge 164 of lower portion 28), and inner surface 32 of lower portion 28 defines distance 112 from center 18 (e.g., at bottom edge 164 of lower portion 28).

Positioned to either side of hinge 60 is first frangible sidewall 68 and second frangible sidewall 70. First frangible sidewall 68 defines outer surface 72, which faces away from axis 8. Second frangible sidewall 70 defines outer surface 74, which also faces away from axis 8.

In a specific embodiment, outer surface 30 of lower portion 28 of annular wall 16 extends further from center 18 than outer surface 168 of hinge 60. In a specific embodiment, inner surface 32 at bottom edge 164 of annular wall 16 is further from inner surface 166 of hinge 60. In a specific embodiment, outer surface 168 of hinge 60 is further from center 18 than inner surface 166 of hinge 60.

Figure 13:
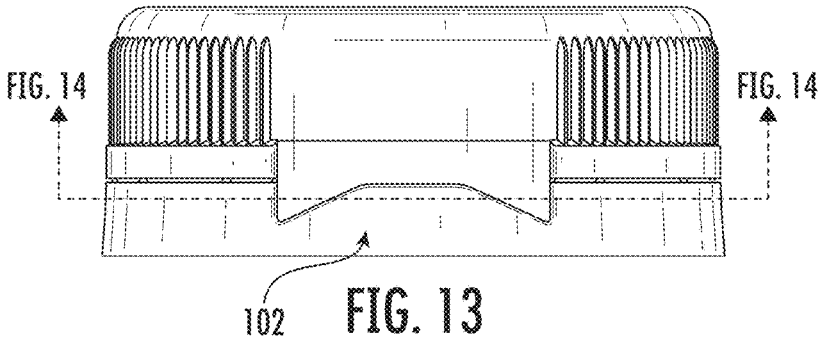
FIG. 13 is a side view of the closure of FIG. 1.
Figure 14:
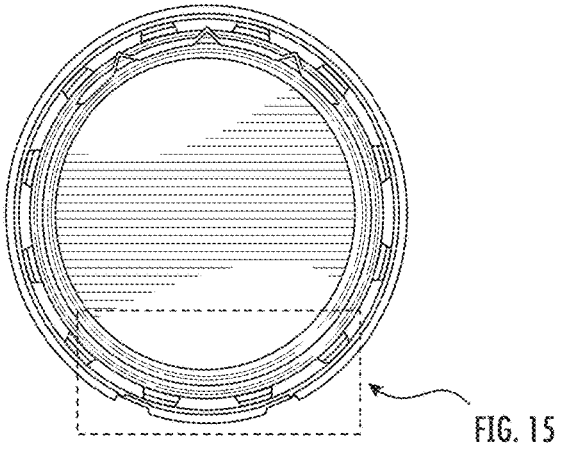
FIG. 14 is a cross-section view of the closure of FIG. 13.
Figure 15:
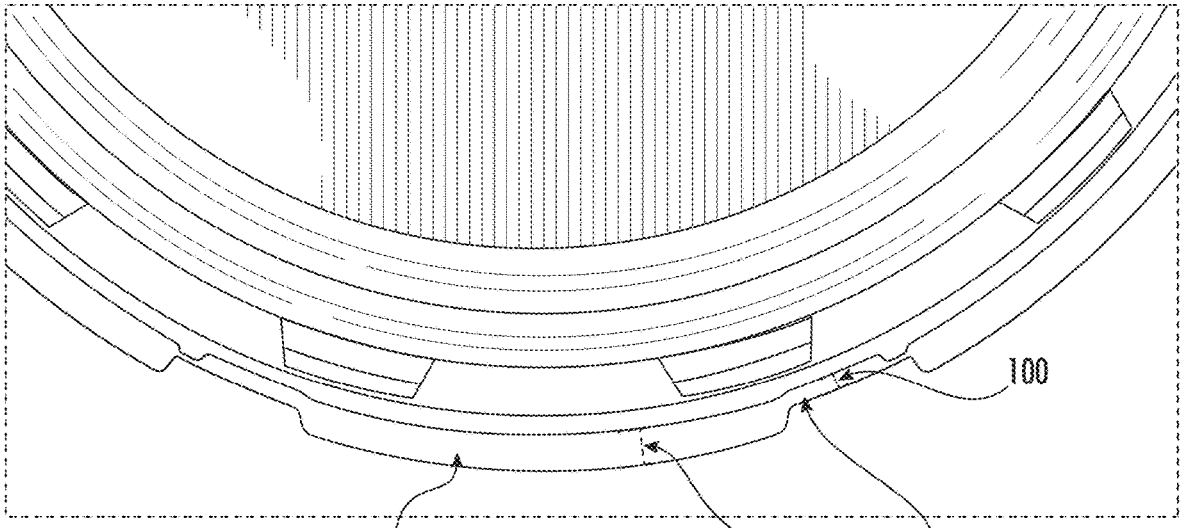
FIG. 15 is a detailed cross-section view of the closure of FIG. 14.

Turning to FIGS. 13-15, base 102 beneath hinge defines a thickness 104 and hinge 60 defines thickness 100. In a specific embodiment, thickness 100 of hinge is wider than thickness 104 of base 102.

Figure 16:
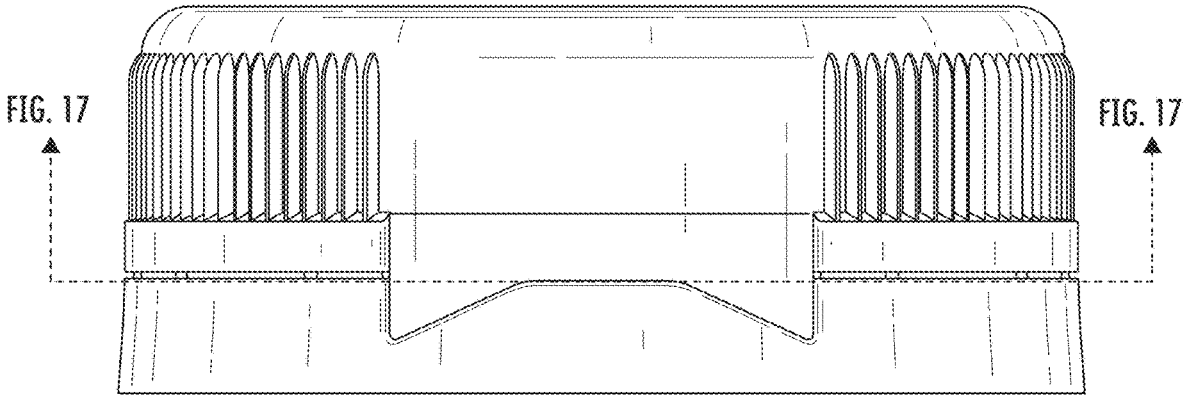
FIG. 16 is a side view of the closure of FIG. 1.
Figure 17:
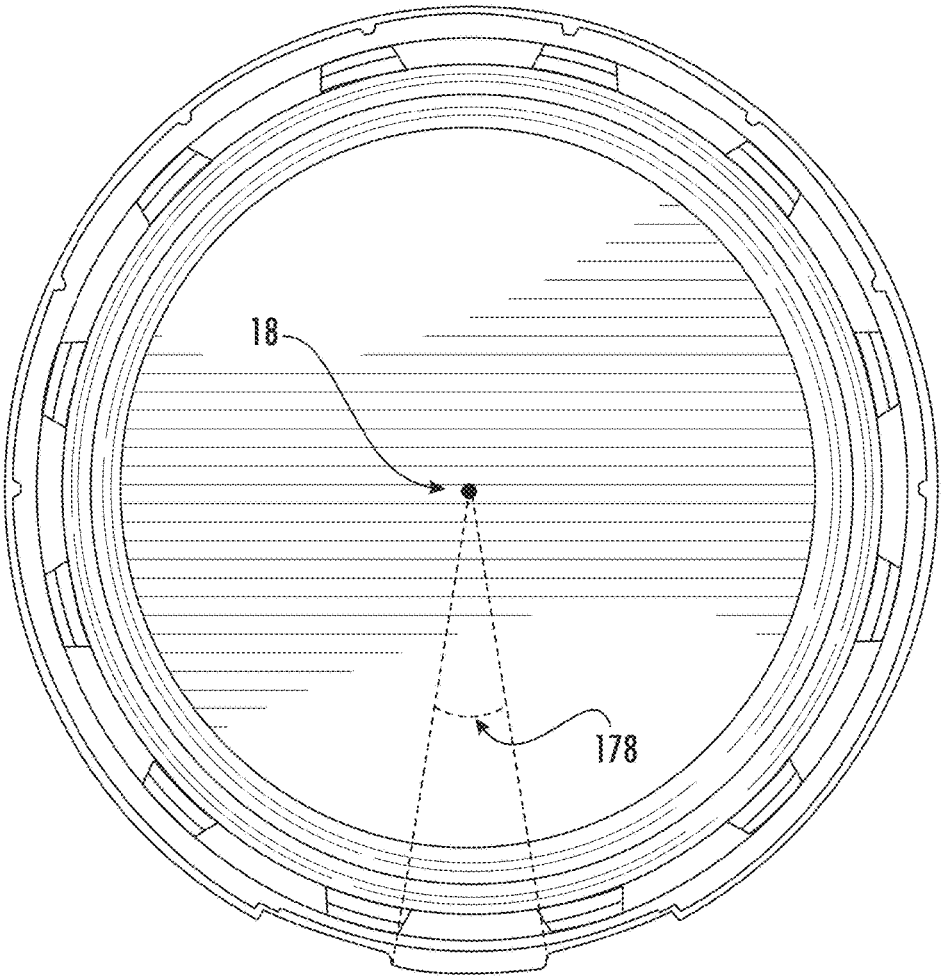
FIG. 17 is a detailed cross-section view of the closure of FIG. 16.
Figure 18:
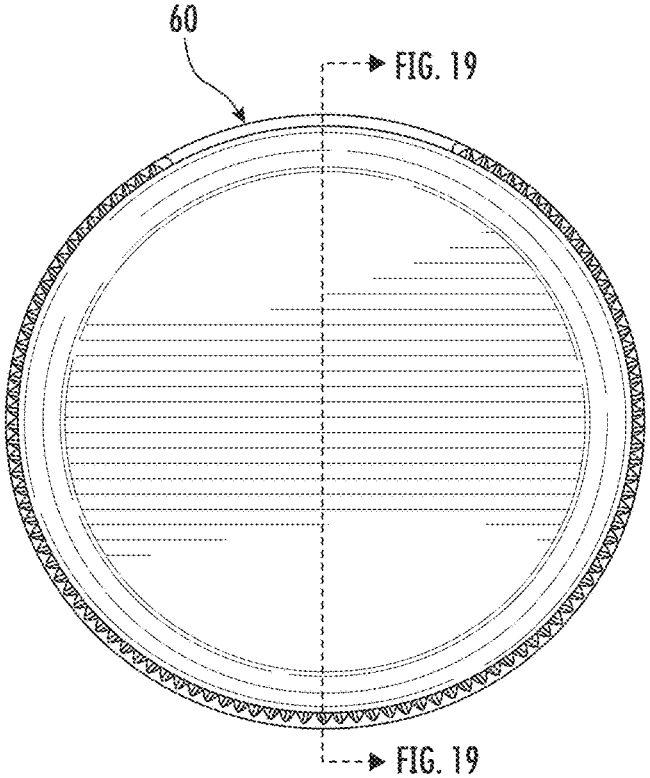
FIG. 18 is a top view of the closure of FIG. 1.
Figure 19:
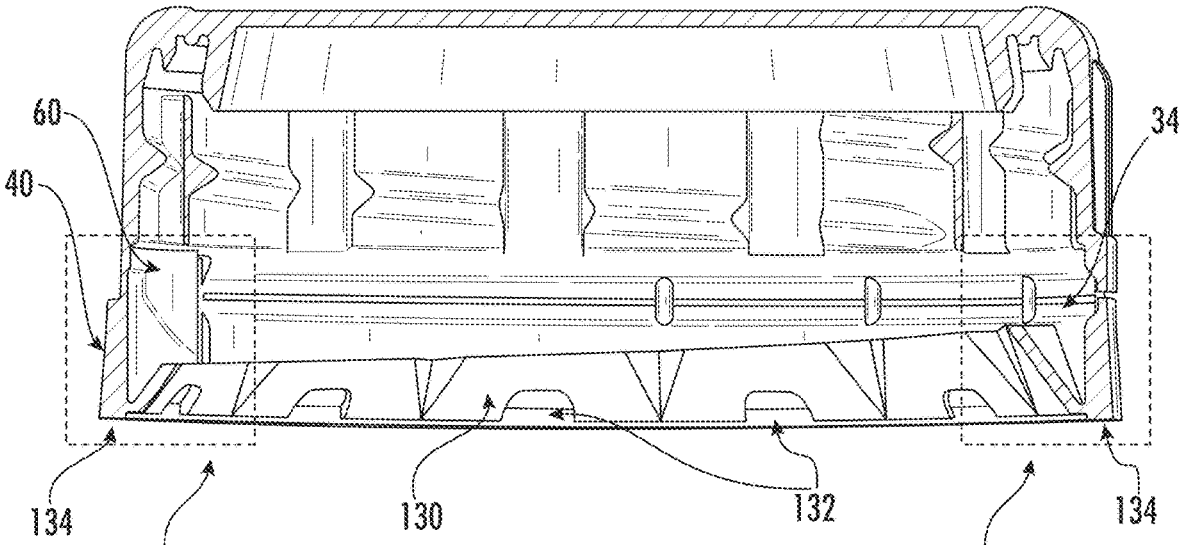
FIG. 19 is a cross-section view of the closure of FIG. 18.
Figure 20:
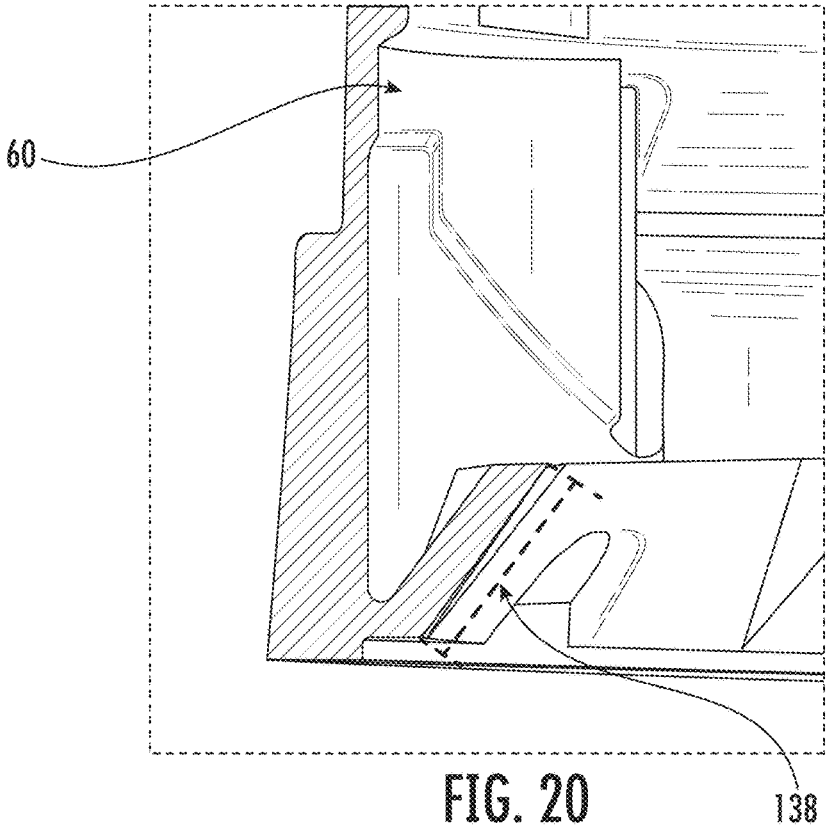
FIG. 20 is a detailed cross-section view of the closure of FIG. 19.
Figure 21:
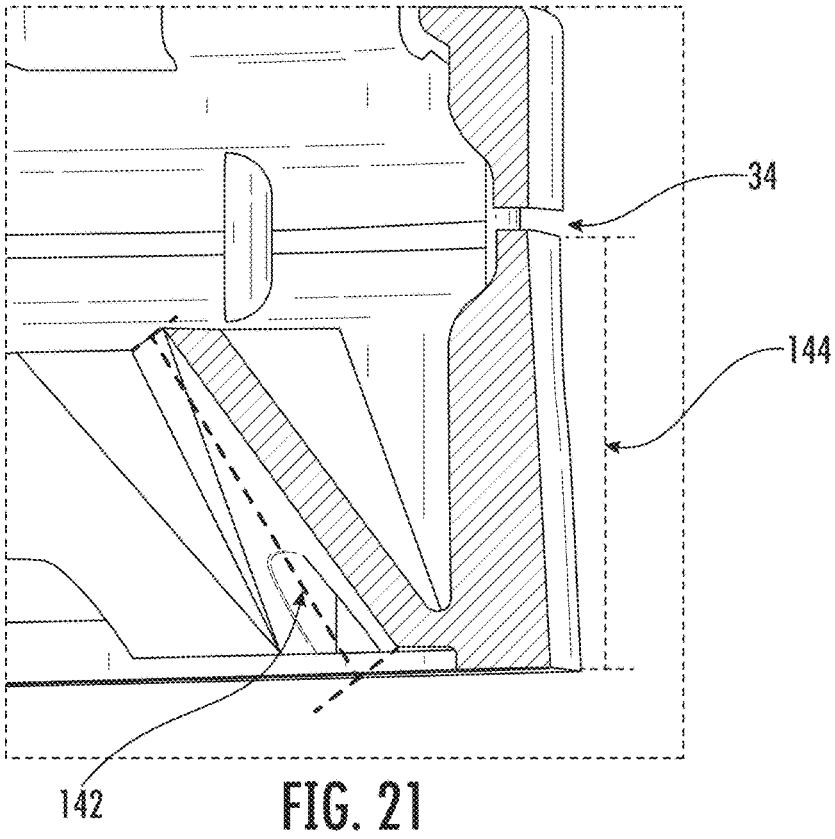
FIG. 21 is a detailed cross-section of the closure of FIG. 19.

Turning to FIGS. 16-17, central portion 62 of hinge 60 extends from first end 170 to second end 172. With respect to center 18, first end 170 and second end 180 define angle 178. In a specific embodiment, angle 178 is between 10 degrees and 60 degrees, and more specifically is between 20 degrees and 50 degrees, and more specifically is between 30 degrees and 55 degrees, and more specifically is between 39 degrees and 41 degrees. In a specific embodiment, angle 178 is less than 50 degrees.

Turning to FIGS. 18-21, various aspects of a tapered interference band 130 are shown. Interference band 130 extends inwards from base 134 of retention band 40. Interference band 130 defines one or more apertures 132.

Interference band 130 extends a varying distance from base 134 at different circumferential positions with respect to axis 8. At the one or more locations below hinge 60 (see FIG. 20), interference band 130 has length 138. At the one or more locations opposite hinge 60 with respect to center 18 (see FIG. 21), interference band 130 has length 142, which is longer than length 138. In a specific embodiment, base 134 defines distance 144 between top of retention band 40 at weakened section 34 and base 134 of retention band 40, when closure 10 is in the closed arrangement.

In a specific embodiment, length 138 is less than 60% of length 142. In a specific embodiment, length 138 is less than 50% of distance 144.

According to an exemplary process of forming closure 10, at a first step a first form of a closure is received. In one example, the first form of the closure is formed via injection molding. In another example, the first form of the closure is formed via compression molding. The first form of the closure is similar to closure 10 except for the differences noted herein. The closure includes a top panel 12 defining an upper surface 160 and an opposing lower surface 162, a rotational axis 8 around which the top panel 12 is centered, a cylindrical wall (which includes both annular wall 16 and retaining band 40, as explained further herein) extending from the lower surface 162 of the top panel 12, and a hinge 60 extending inwardly from the cylindrical wall towards the rotational axis 8. Notably, the first form of the closure does not yet define a retaining band 40 that is separate from the annular wall 16 of closure 10.

Then a blade is used to cut the cylindrical wall of the first form of the closure, thereby forming a retaining band 40 and an annular wall 16. The retention band 40 is pivotally attached to the bottom edge of the annular wall 16 by the hinge 60 and attached to the bottom edge by a plurality of frangible members that break a first time the annular wall 16 is pivoted with respect to the retention band 40.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein the article "a" is intended to include one or more than one component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another, or with the two members and any additional member being attached to one another. Such joining may be permanent in nature or alternatively may be removable or releasable in nature. Various embodiments of the invention relate to any combination of any of the features, and any such combination of features may be claimed in this or future applications. Any of the features, elements, or components of any of the exemplary embodiments discussed above may be utilized alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A closure comprising:

a top panel defining an upper surface and an opposing lower surface;

a rotational axis around which the top panel is centered;

an annular wall extending from the lower surface of the top panel to a bottom edge of the annular wall;

an inner surface of the annular wall facing towards the rotational axis, the inner surface at the bottom edge of the annular wall extending a first distance from the rotational axis;

a hinge having an inner surface that extends a second distance from the rotational axis that is less than the first distance; and a retention band pivotally attached to the annular wall by the hinge and attached to the bottom edge by a plurality of frangible members that break a first time the closure is opened and the annular wall is pivoted away from the retention band.

2. The closure of claim 1, the hinge extends circumferentially around the rotational axis from a first end to a second end, the first end and the second end define an angle with respect to the rotational axis between 10 degrees and 65 degrees.

3. The closure of claim 1, the hinge extends circumferentially around the rotational axis from a first end to a second end, the hinge defines a lower edge and an opposing upper edge, wherein the hinge defines a first height between the lower edge and the upper edge at the first end of the hinge, the hinge defines a second height between the lower edge and the upper edge at the second end of the hinge, and the hinge defines a third height between the lower edge and the upper edge at a central portion of the hinge circumferentially halfway between the first end and the second end, wherein the third height is less than each of the first height and the second height.

4. The closure of claim 3, wherein the central portion of the hinge that defines the third height extends circumferentially around the rotational axis from a first central end to a second central end, the first central end and the second central end define an angle with respect to the rotational axis that is less than 50 degrees.

5. The closure of claim 3, wherein the first end of the hinge and the lower edge of the hinge define an angle between 55 degrees and 80 degrees.

6. The closure of claim 3, the hinge defines a central line that extends parallel to the rotational axis of the closure, wherein the hinge is symmetrical with respect to the central line.

7. The closure of claim 3, wherein the hinge is coupled to the annular wall via a plurality of elongate frangible connections.

8. A method of forming a closure comprising:

receiving a closure, the closure comprising:

a top panel defining an upper surface and an opposing lower surface;

a rotational axis around which the top panel is centered;

a cylindrical wall extending from the lower surface of the top panel; and a hinge extending inwardly from the cylindrical wall towards the rotational axis;

using a blade to cut the closure, the blade circling the entire circumference of the closure to form:

an annular wall extending from the lower surface of the top panel to a bottom edge of the annular wall; and a retention band pivotally attached to the annular wall by the hinge and attached to the bottom edge by a plurality of frangible members that break a first time the closure is opened and the annular wall is pivoted away from the retention band.

9. The method of claim 8, wherein:

an outer surface of the annular wall faces away from the rotational axis, the outer surface at the bottom edge of the annular wall extending a first distance from the rotational axis; and an outer surface of the hinge extends a second distance from the rotational axis that is less than the first distance.

10. The method of claim 8, the hinge extends circumferentially around the rotational axis from a first end to a second end, the first end and the second end define an angle with respect to the rotational axis, wherein the angle is between 30 degrees and 60 degrees.

11. The method of claim 8, the hinge extends circumferentially around the rotational axis from a first end to a second end, the hinge defines a lower edge and an opposing upper edge, wherein the hinge defines a first height between the lower edge and the upper edge at the first end of the hinge, the hinge defines a second height between the lower edge and the upper edge at the second end of the hinge, and the hinge defines a third height between the lower edge and the upper edge at a central portion of the hinge circumferentially halfway between the first end and the second end, wherein the third height is less than each of the first height and the second height.

12. The method of claim 11, wherein the central portion extends circumferentially around the rotational axis from a first central end to a second central end, the first central end and the second central end define an angle with respect to the rotational axis that is between 20 degrees and 50 degrees.

13. The method of claim 11, wherein the first end of the hinge and the lower edge of the hinge define an angle between 40 degrees and 85 degrees.

14. A closure comprising:

a top panel defining an upper surface and an opposing lower surface;

a rotational axis around which the top panel is centered;

an annular wall extending from the lower surface of the top panel to a bottom edge of the annular wall;

a hinge extending from the annular wall;

a retention band pivotally attached to the annular wall by the hinge and attached to the bottom edge by a plurality of frangible members that break a first time the closure is opened and the annular wall is pivoted away from the retention band; and an interference band that extends from the retention band inwardly towards the rotational axis, the interference band extends a first length from a base of the retention band at a first location beneath the hinge, and the interference band extends a second length from the base of the retention band at a second location, wherein the second location is opposite the first location with respect to the rotational axis, and wherein the second length is greater than the first length.

15. The closure of claim 14, wherein the first length is less than 60% of the second length.

16. The closure of claim 14, wherein the first length is less than 50% of a third length from a bottom of the retention band to a top of the retention band.

17. The closure of claim 14, the closure further comprising:

an inner surface of the annular wall facing towards the rotational axis, the inner surface of the annular wall at the bottom edge of the annular wall extending a first distance from the rotational axis; and an inner surface of the hinge facing towards the rotational axis, the inner surface of the hinge extending a second distance from the rotational axis that is less than the first distance.

18. The closure of claim 14, the closure further comprising:

an outer surface of the annular wall facing away from the rotational axis, the outer surface at the bottom edge of the annular wall extending a first distance from the rotational axis; and an outer surface of the hinge facing away from the rotational axis, the outer surface of the hinge extending a second distance from the rotational axis that is less than the first distance.

19. The closure of claim 14, the hinge extends circumferentially around the rotational axis from a first end to a second end, the hinge defines a lower edge and an opposing upper edge, wherein the hinge defines a first height between the lower edge and the upper edge at the first end of the hinge, the hinge defines a second height between the lower edge and the upper edge at the second end of the hinge, and the hinge defines a third height between the lower edge and the upper edge at a central portion of the hinge circumferentially halfway between the first end and the second end, wherein the third height is less than each of the first height and the second height.

20. The closure of claim 19, wherein the hinge comprises a central portion over which the hinge defines the third height, the central portion extends circumferentially around the rotational axis from a first end to a second end, the first end and the second end define an angle with respect to the rotational axis that is less than 50 degrees wherein the first end of the hinge and the lower edge of the hinge define an angle between 55 degrees and 80 degrees.

* * * * *